United States Patent [19]

Fleissner

[11] 3,942,695

[45] Mar. 9, 1976

[54] PROCESS AND APPARATUS FOR THE FORMATION OF LOOPS OF TEXTILE MATERIAL IN A TREATMENT CHAMBER

[75] Inventor: Hans Fleissner, Riehen-Basel, Switzerland

[73] Assignee: Vepa Aktiengesellschaft, Switzerland

[22] Filed: Aug. 31, 1973

[21] Appl. No.: 393,299

[30] Foreign Application Priority Data

Aug. 31, 1972 Germany ..... 2242890

[52] U.S. Cl. ..... 226/1; 34/157; 68/160; 118/32; 226/104

[51] Int. Cl.[2] ..... B65H 17/42

[58] Field of Search ..... 226/104, 105, 107, 14, 226/170; 34/157; 68/160; 118/32

[56] References Cited

UNITED STATES PATENTS

| | | | |
|---|---|---|---|
| 1,494,307 | 5/1924 | Hinnekens | 226/105 |
| 1,557,368 | 10/1925 | Kershaw | 34/157 |
| 2,035,227 | 3/1936 | Fowler | 226/14 |
| 2,196,921 | 4/1940 | Hurxthal | 226/105 |
| 2,534,054 | 12/1950 | Parkes | 226/105 X |
| 2,988,255 | 6/1961 | Colker | 226/104 |
| 3,287,822 | 11/1966 | Beasley | 34/157 |

*Primary Examiner*—Richard A. Schacher
*Attorney, Agent, or Firm*—Craig & Antonelli

[57] ABSTRACT

A process for the formation of loops freely suspended over a plurality of supporting means for the conveyance of textile material, particularly web-shaped material, which is sensitive to longitudinal tension through a treatment chamber, e.g. a steamer, slowly traversed by the supporting means, e.g. supporting rollers, supported by an endless conveying means, e.g. an endless conveyor chain includes the steps of maintaining supporting means coming into contact with the material constantly in rotation during the formation of the loops, and effecting the loop formation by the relative motion of successive supporting means with respect to one another.

53 Claims, 8 Drawing Figures

PROCESS AND APPARATUS FOR THE FORMATION OF LOOPS OF TEXTILE MATERIAL IN A TREATMENT CHAMBER

This invention related to a process and apparatus for the formation of textile material, e.g. webs, bands, sheets, etc., into loops freely suspended over supporting rollers for the conveyance of especially such material which is sensitive to longitudinal stretching and is web-shaped through a treatment chamber, this chamber being slowly traversed by the guide elements, e.g. rollers, supported by an endless conveying means, for example, an endless conveyor chain. Treatment devices of interest in this connection, wherein the process and apparatus of this invention are utilized, are the conventional festoon steamers and in certain cases also the travelling loop steamers.

The formation of the loops of textile materials in traveling loop steamers is basically effected without any problems because these steamers are employed only in case of materials, the traveling speed of which is only minor, and the roller characteristics of such steamers permit the material to form a pronounced curve in the lower point of return of the loop during the automatic, unguided deflection. Only in this case is it possible to convey the material continuously at the delivery speed through the treatment chamber of a traveling loop steamer.

Traveling loop steamers for feeding speeds of 40–80 m. and 100 m. per minute would be very advantageous, but they cannot be accomplished. It is impossible to obtain with this system a trouble-free conveyance of the material at this speed. For such a purpose, only festoon steamers are suitable. In these steamers, an endless conveying means travels with at least two chains wherein the two ends of supporting elements are held. Suitable supporting elements are round rods, triangular rods, rollers, or the like. All of these elements are to be encompassed within the scope of the present application and will be denoted hereinbelow as supporting element means and more particularly as rollers for the sake of simplicity. The material is suspended over these supporting means, disposed in the region of the ceiling of the apparatus, on both sides in freely hanging loops and is carried transversely through the treatment chamber by means of the supporting means which are gradually moved—pushed or pulled—in the conveying direction of the material.

In this conveying mode, the feeding speed of the material is completely insignificant. The only important consideration, for example, for uniform dye fixation, is only that the material does not rest, i.e., stand still, on the rollers during this conveyance, but rather is shifted with respect to the supporting means. This can be effected at a moderate speed which—as is known, is made possible by the intermittent rotation of the supporting means carrying the material.

Another important prerequisite for such a festoon steamer is that the material touch the conveying or other auxiliary elements only on one side. This is ensured by the formation of the loops as suspended loops which are not guided at the bottom, i.e., are not forcibly deflected in the inner loop. However, the loop formation, which must be accomplished even in case of an only unilaterally guided material, does cause problems.

A festoon steamer is known wherein the material entering the steamer is pulled upwardly by a sieve drum under a suction draft, which drum is arranged in the zone of the ceiling of the apparatus and is halfway covered by the material; the material, while hanging downwardly from the sieve drum, is placed in loops around the supporting elements with the aid of a blowing unit. This loop formation makes it possible to effect contact with the material only on one side, but the conveying seive drum must be arranged at the very top in the zone of the ceiling, with medium circulation and with the associated blowing or fan unit. Both of these devices prevent a quiet steam atmosphere in the treatment chamber, which is necessary due to a 100% absence of air, and both devices exert a considerable longitudinal force on the material which, in case of tension-sensitive goods, must be absolutely avoided. The sieve drum pulls the liquid-weighted material from the steamer bottom, where the inlet and outlet for the material are provided in order to prevent a spontaneous entrance of air, upwardly to far beyond the plane of the rollers in the zone of the ceiling, and the blowing unit stresses the sensitive material during the entire period of loop formation, whereby the material is forced to absorb pressure fluctuations due to fluttering motions.

Another conventional loop-forming method causes a lesser longitudinal tension; in this method, the respectively following loop is preformed between the last guide roller forming a loop and a guide roller serving as the material-introducing roller, wherein the latter is associated at the top with a supporting roll to ensure uniform feeding of the material. The subsequent guide roller, carried by a conveying means and coming from the downward direction enters the material hanging downwardly from the nip of the rollers into the steamer. The roller, which continues its upward movement, then carries the loop, previously fixedly determined with respect to its length of material, to the level of the conveying rail extending longitudinally through the steamer and receiving the guide roller.

A disadvantage of this method is the necessary bilateral contacting of the material by the introducing and supporting rollers in the zone of the material inlet, which furthermore, for reasons of the principle involved, cannot be arranged at the bottom of the steamer. For at the bottom, it would be impossible to form a loop with a predetermined length of material. Furthermore, one and the same point of the material is in constant contact with the upwardly moving, hot roller during the loop forming step, resulting in a nonuniform fixation of the dye at this point in the extremely sensitive initial stage of the treatment. Another disadvantage is that the dye accumulates in a sage of the loop. Although this runnel of dye does not remain uniformly at the same point of the material during the loop formation, but rather recedes downwardly in the material transporting direction while the material moves upwards, this dye runnel will travel downwardly in opposition to the transporting direction of the material during the conveyance of the material through the steamer, where the rollers rotate slowly by means of an auxiliary chain or the like in the transporting direction, thus again covering the zone which was covered by the dye during the loop formation. This, of course, likewise ensues in an undesired result in fixation of the dye.

The invention is based on the problem of developing especially universal festoon steamer for printed or dyed knit fabrics or woven goods which optimally meets all possibly occurring technical requirements for the flawless fixation of dye with the textile materials. An absolute prerequisite is that the textile material be contacted only on one side even during the loop formation. The textile material is to be at rest relatively to the rollers, not only while the material is being conveyed through the steamer. However, there must be no instant at all during the treatment, especially at the beginning where the textile material is stationary on a roller. A condition for a material-preserving treatment is that the material to be conveyed to the respectively desired level without any tension. This is problematic in case of arranging the inlet and outlet of the material in the zone of the steamer bottom, which is desirable in order to prevent the spontaneous entrance of air into the steamer. Also, the steamer must always contain a quiet and 100% pure steam atmosphere, which must not be disturbed, either, by the loop-forming mechanisms.

These many different conditions are met if the elements contacting the material are preferably constantly kept in rotation, especially when forming the loops, and if the loop formation is effected by the relative motion of successive elements. Consequently, the material can only be contacted by the supporting elements, particularly the rollers unilaterally from the bottom side, from the beginning to the end of the steamer, even during the feeding and discharging, as well as during the loop formation, and also during the residence treatment. The loops are formed between respectively two rollers rotating at a differential speed, on which the material is held solely by friction.

A special facilitation of the loop formation in accordacne with this system is provided if the continuously rotating rollers contacted by the material during the loop formation additionally vary their mutual distance. For, if the spacing of the rollers is large during the loop formation, whereas they are in close proximity to each other during the residence treatment in the steamer, a disturbance of the loop formation by rollers is avoided with great probability, especially in case of treatment of stiff printed material.

The process of this invention can be made even more sophisticated in many details to ensure a trouble-free conveyance of the material through the steamer. The above-mentioned measures as well as those set forth below are of inventive importance individually as well as in combination with other features for solving the posed problem. Thus, it is advantageous, for example, to provide that the textile material, upon its first contact with a roller, maintains its feeding speed exactly. In other words, the textile material must not be accelerated or decelerated in sudden bursts, which would result in the exertion of longitudinal tension on the material. This is made possible by the feature that the respectively subsequent, loop-forming roller, upon first contact with the textile material, travels longitudinally and rotates at speeds which, together, result in the feeding speed of the material. In this connection, it is to be kept in mind that the roller, during the formation of the loop, executes a motion in the direction of, for example, the steamer ceiling, which is superimposed by the rotating motion of the roller. Both motions must be adapted to each other so that the outer surface of the roller does not have a differential speed with respect to the material.

The loops are to be formed, in accordance with the invention, by the differential speed of successive rollers. It is advantageous not to drive each successive roller at a different speed. Therefore, it is suggested according to the present invention to provide that the roller which again comes in contact with the material first rotates at a high speed, the following roller rotates more slowly, and again the following roller or, preferably, only a few elements further on, rotate continuously at an even slower velocity. The acceleration and deceleration of the rollers to the predetermined speed are not to be effected suddenly, but rather in a throttled mode of operation, again in order to ensure a maximally tensionless conveyance of the material. Also, this throttling provides a gentle treatment of the material.

The above-mentioned steps of the process can be employed at any level of the steamer for the loop formation. It is possible, for example, first to convey the material into the zone of the ceiling. This transport should be conducted with the aid of driven rollers or the like without tension. However, it is more advantageous to form, preferably first preform, the loops in the lower zone of the treatment device between two rollers of the chain, and then to fully form the loops during the conveyance of the material in the zone of the ceiling of the apparatus. Another embodiment provides to guide the rotating, upwardly traveling roller against the underside of a loop already formed between a fixed auxiliary roll and a roller, thus forming, from this one loop, now two loops laterally suspended from this roller. In another embodiment, the accelerated, upwardly moving roller is laterally guided in a loop already formed between an auxiliary roll and a roller, thus taking over this loop in unchanged form.

In all of these embodiments, it is advantageous that the loops are not formed in full length immediately between two rollers. This avoids auxiliary means which must retain the textile material on the guide rollers to prevent shifting of this material. In the process of this invention, the textile material is held on the rollers solely by friction. By a simple determination of the rotating speed of the rollers, it is furthermore possible to determine the length of the loops, dependent on the sensitivity of the material, over any desired height. In all of these features, there is merely the requirement that the weight of a rather long loop must not be greater than the force of the friction of the material on the here controlling, adjacent roller, plus the weight of of the material of the shorter loop. This condition can readily be met.

The features necessary for the constuctional solution of the process of this invention will be set forth below.

An absolute requirement for this process is the drive means for the rollers coming into contact with the material. This driving operation is preferably accomplished by one or more auxiliary chains. The series-disposed auxiliary chains have, of course, different speeds, in order to effect the gradual formation of the loops in their full length.

The feature of this invention to make the spacing of the respective rollers to be variable is a special facilitation in the loop formation and contributes toward the safety factor. The mutual spacing of a certain number of rollers is to be consistently the same, whereas the spacing of the rollers with formed loops is to be smaller than the spacing of rollers without or with only partially formed loops. This is made possible quite simply by providing that the endless conveying means laterally extended in the steamer housing and serving for the transportation of a plurality of rollers consist, for example, of chain links which can be telescoped. One embodiment consists of chain links which can be tilted up- and downwardly in the manner of an accordion. The rollers are then to be mounted at large spacings to such a chain, held in the stretched condition. If, then, the chain is pushed together in the residence section of the steamer, the rollers are disposed in close proximity for receiving a large quantity of material. Also, the conveying means can consist of a line, rope, or the like, to which the rollers are affixed at spacings. In any event, only a few rollers are thus necessary for the total system which also has an advantageous effect on the manufacturing cost.

Several chain-guiding and auxiliary devices are possible where the principle of the loop formation according to this invention can be utilized. For example, it is possible to form the loops in the zone of the ceiling of the treatment apparatus, for which purpose the material must first be transported in an obliquely upwardly directed path toward the ceiling. Pulling a vertically hanging material would be infeasible in this case, since the liquid-saturated material would have too great a weight over such a length of material corresponding to the height of the apparatus. The transportation should be accomplished by means of driven guide rollers with an endless conveyer belt. It is also possible to provide a sieve drum under a suction draft which simultaneously serves for the heating of the material, but which does not pull the material upwardly but only heats the material during contact with the drum and conveys the material without tension during this step. From the end of this material conveying means, the material first passes straight to the preceding roller. The loop is then gradually formed by the differential speed of this roller and the feeding speed provided by the conveying means.

More advantageous is an embodiment wherein a feed roll, which rotates at the feeding speed and is preferably heated, is arranged behind the inlet end wall of the housing in the lower zone of the height of the apparatus; the first loop is then preformed between this feed roll and a further auxiliary roller and a subsequent roller of a conveying chain. In this connection, it is advantageous to deflect the conveying chain with the rollers somewhat below this feed roll in the conveying direction of the material, preferably so that it is obliquely inclined downwardly, for some distance, corresponding approximately to the spacing between two guide rollers when the conveying chain is stretched out. This distance is then to be associated with a first auxiliary chain. In this way, the feed roll constitutes a connecting member for the subsequent loop to the successive roller at the conveying chain.

Another embodiment resides in extending the conveying chain with the rollers, close to the inlet, upwardly in an oblique direction over the entire height; in the lower zone, at the level of the above-mentioned feed roll, a first auxiliary chain for driving the rollers at approximately feeding speed is arranged over the length of the distance of two successive rollers when the chain is stretched out.

It is furthermore advantageous for a tensionless conveyance to extend the conveyer chain so that it is inclined in the downward direction also at the end of the apparatus, and to associate an auxiliary chain for a more rapid driving action with the rollers which are suspended at that point with the chain stretched out. In this way, the loops are then slowly dissolved.

Several embodiments of the apparatus of this invention are illustrated in the drawing. Additional features of the present invention will be understood in the following detailed description with reference to these embodiments wherein.

Figure 1:
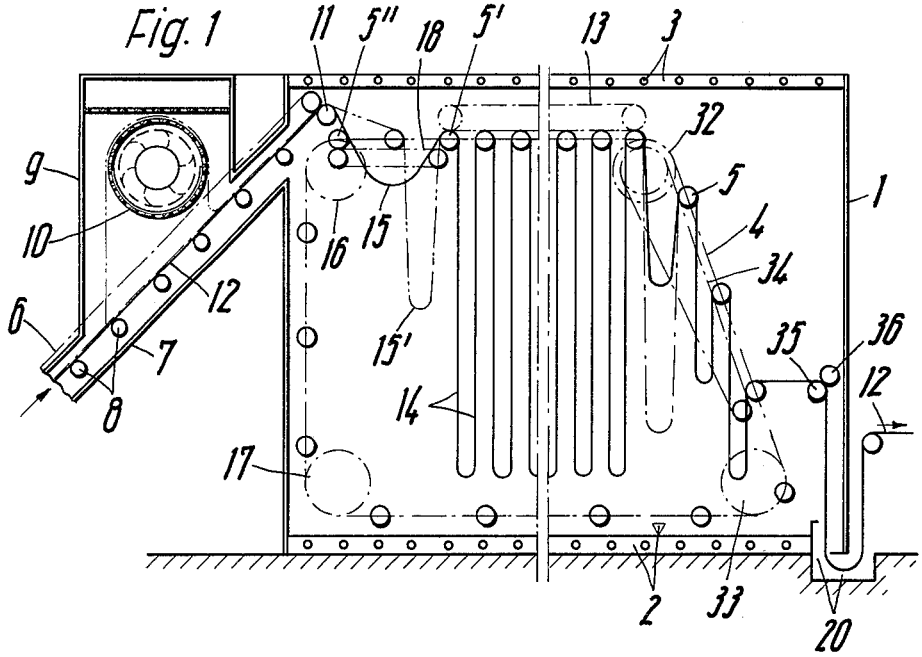
FIG. 1 shows a longitudinal sectional view of a festoon steamer of this invention wherein the loops are formed in the zone of the ceiling.

A festoon steamer consists of a housing 1, the bottom of which has a heated water sump 2. The ceiling 3 of the housing is likewise heated by heat-exchange with steam or other heated fluid in order to avoid droplet condensation. The housing 1 is traversed by an endless conveying means 4 to which the conveying or supporting means, i.e., rollers 5 are attached. In the illustrated embodiments, respectively, one chain 4 is extended along both sides of the housing, conveying rollers 5 being held laterally in these chains. The chains are guided with the housing by means of chain sprockets 16, 17, 32, 33. During the return of the conveying rollers from the wheel 32 to the sprocket 16—i.e. from the zone of the material outlet by way of the steamer bottom up to the zone of the steamer ceiling in the region of the material inlet—the conveying rollers 5 have a large mutual spacing; whereas the rollers are disposed in close proximity to one another during the slow conveyance of the material through the steamer in the vicinity of the ceiling. In order to make this possible, a special chain construction is suggested which can be seen, in particular, from FIG. 5 described hereinbelow.

In the embodiment of FIG. 1, a new loop is formed in the proximity of the textile material inlet at the zone of the steamer ceiling. For this purpose, the material must be transported into this zone of the ceiling without exerting any tension. Since an upwardly pulling action, for example, by means of a sieve drum, is impossible in case of the sensitive textile materials to be treated, a feeding funnel or chute 7 is necessary which guides the material obliquely in the upward direction. The mouth of this chute 7, not shown, must be in the zone of the steamer bottom, so that no air can spontaneously enter the steamer. Several conveying rollers 8 are provided along the length of the chute 7, which rotate while driven with the aid of an auxiliary chain 6. It is possible to dispose above the chute 7 a sieve drum 10 under a suction draft and surrounded by a housing 9, in order to conduct the material lifted off the rollers 8 about the sieve drum 10 for heating the material more quickly, optionally to HT temperatures. In any event, the sieve drum must be arranged outside of the housing 1 in order to avoid turbulence in the steam atmosphere.

In the zone of the ceiling of the first embodiment, a feed roll 11 is disposed at the end of the chute; this roll is likewise driven so that it rotates at the feeding speed. From there, the material 12 is first held extending up to the following roller 5'. However, this following roller is driven by the second auxiliary chain 13 only at a lower rotating speed. This speed is of such a magnitude that the material is not affected with respect to the fixation results by the effect of the temperature of the conveying rollers. Furthermore, the runnel of dye forming in the loops is to be taken into account. Therefore, the speed of rotation of the rollers in the zone of the auxiliary chain 13 should be such that the length of a loop 14 has passed once over a roller 5 during the conveyance from the inlet to the outlet of the steamer.

Due to this slow speed of rotation of the following roller 5', the new loop 15 is automatically formed between this roller and the feed roll 11. The sliding of the material over the roller 5' is prevented by the weight of the material from the roller 5' to the feed roll 11, which, in total with the frictional force on the conveying roller 5', must not be smaller than the weight of the finished loop 14.

While the material 12 continues to travel over the feed roll 11 with the feeding speed, a new conveying roller 5'' passes around the chain sprocket 16 which pulls the chain 4 vertically upwardly from the chain sprocket 17. Prior to contacting of the roller 5'' with the textile material 12, this roller is accelerated by means of the first auxiliary chain 18 to a speed equal to the velocity at which the material passes the roller 5'' with the loop 15 being formed. Consequently, there is not the slightest relative speed between the material 12 and the roller 5''. Thus, the material is taken over by the roller 5'' without tension and is further conveyed continuously.

While the chain 4 is further moved in the conveying direction, the loop 15', indicated in dot-dash lines, is gradually formed. If the spacing between the rollers 5' and 5'' is equal to the spacing of the rollers in the zone of the second auxiliary chain 13, then the loop 15, 15' has been formed into the loop 14 in its full length and is now moved only slowly at the speed according to the auxiliary chain 13. At the instant which the speed of rotation of the roller 5'' is decelerated to the speed in dependence on the auxiliary chain 13, the weight of the material suspended between the feed roll 11 and the roller 5'' is again of such a magnitude that automatically a new loop can be formed.

Figure 2:
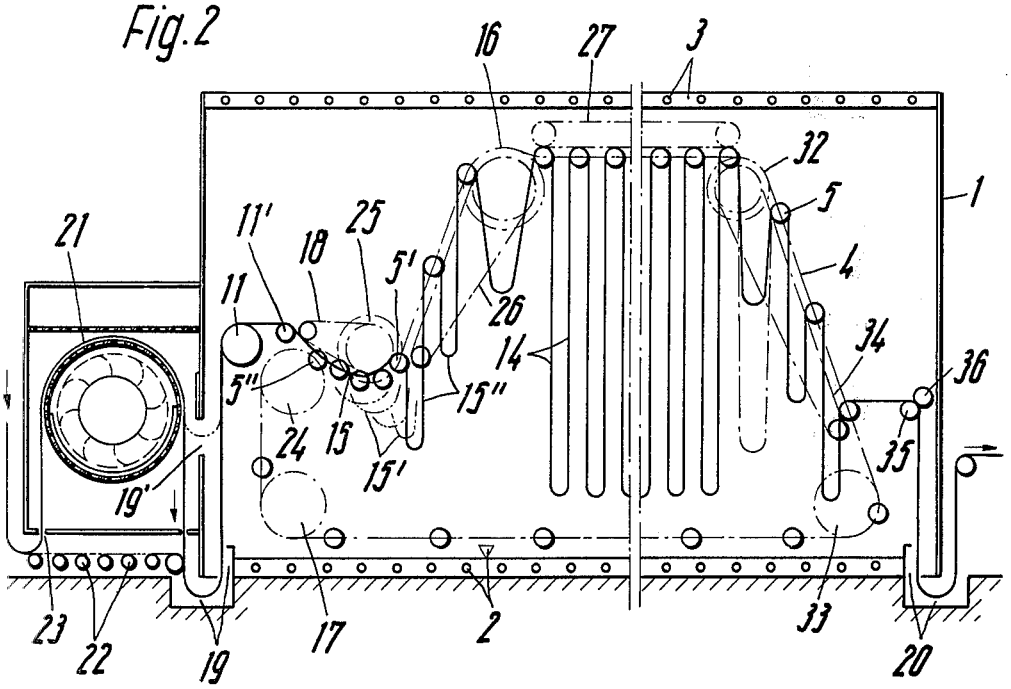
FIG. 2 shows the festoon steamer according to FIG. 1, wherein the loops are first preformed in the lower zone of the height of the apparatus.

Another principle for the loop formation is illustrated in FIG. 2. Here, the loops are first preformed between two successive rollers and are fully formed after having been conveyed into the zone of the ceiling of the apparatus. This embodiment advantageously avoids the chute 7 of FIG. 1, which takes up a large amount of space in its dimensions. The same holds true for the embodiments of FIGS. 3 and 4.

In all these examples, the inlet as well as outlet 19, 20 are provided in the zone of the bottom of the steamer. In this way, no air can spontaneously enter the steamer, except for air entrained perhaps by the material. These minor quantities of air are collected in the zone of the bottom due to the quiet steam atmosphere in the steamer, and can be removed at that point by suction. A 100% steam atmospheres is ensured in the steamer.

If it is desired to heat the material first intensively, optionally to temperatures of around 200° C., a sieve drum under a suction draft, designated by reference numeral 21, can be arranged in front of the steamer. The fan mounted at the end face of the drum is shown schematically by the blades in dash lines. The sieve drum should be placed in the vicinity of the bottom, so that the loops formed laterally of the drum 21 have only a minor weight of material. When using the sieve drums as heating units, the inlet for the material can be provided approximately at the level where the material leaves the sieve drum. The inlet for the material illustrated in the drawing, which can be closed off, is denoted by numeral 19'. If the sieve drum 21 is not to be employed, the material travels over a roller train 22 underneath the sieve drum 21 to the inlet 19. In any event, the inlet 23 to the sieve drum unit should also be arranged in the zone of the bottom of the steamer.

The textile material is again fed into the steamer first of all by the feed roll 11. This feed roll can also be designated as a heating roll, by passing a heating medium therethrough. The feed roll is disposed behind the inlet-side end wall of the housing, if possible in the lower zone of the height of the apparatus, in order to keep the length of the loops small from the inlet 19 to the feed roll 11. The subsequent loop is, in turn, formed following the feed roll 11. For this purpose, the chain 4 travels over an additional sprocket 24 arranged closely underneath and in the proximity of the feed roll 11. Another chain sprocket 25 subsequently guides the chain 4 upwards again in the direction toward the chain sprocket 16 arranged in the zone of the ceiling of the device. Preferably, the chain sprocket 25 is arranged so that the chain 4 is guided obliquely downwardly, but in any event horizontally, away from the sprocket 24.

Just as in the embodiment of FIG. 1, the weight of the material between the following roller 5' and the feed roll 11 or a further auxiliary roller 11', with the material being extended in the straight condition, is at least so large that automatically a new loop 15 is formed, namely, without the material being able to slide along the roller 5'. In any event, the roller 5' rotates, at the instant where the loop 15'' has just been preformed, with approximately the feeding speed. For this purpose, the first auxiliary chain 18 is again employed, which drives the rollers 5 moving between the auxiliary roller 11' and the chain sprocket 25 at approximately the feeding speed. If the roller 5', during the further conveying of the chain 4, moves further upwardly from the drawn position, it enters the zone of the second auxiliary chain 26 which drives the roller at a lower speed of rotation. Consequently, the loop 15', indicated in dot-dash lines, gradually forms between the roller 5' and the following roller 5'' which passes into the region of the first auxiliary chain 18. The length of the preformed loop 15'' remains the same during the conveyance until the ceiling of the steamer has been reached. This length is only changed again when the third auxiliary chain 27 determines the speed of rotation of the roller 5. Thus, the loop suspended between the last roller under the effect of the auxiliary chain 27 and the subsequent roller, which is still in the zone of the auxiliary chain 26, is formed in its full length into the loop 14 only in the region of the ceiling.

This stepwise formation of a loop has several advantages. On the one hand, the already partially formed loop can be conveyed upwardly within the steamer without tension, thus also eliminating the feeding funnel of FIG. 1. On the other hand, a greater variation of lengths of the fully formed loop 14 is made possible.

Indeed, any desired loop length—namely a loop utilizing the full height of the steamer, and also a loop which is quite small—can be formed without danger and without any problems. One must only keep in mind that the weight of the partially formed loop, or of the loop to be formed between a first roller and a second roller is at most equal to the weight of the material of the loop between the second roller and a third roller plus the force of friction of the material on this second roller. When considering this rule, a sliding of the material over a roller is made impossible.

Figure 3:
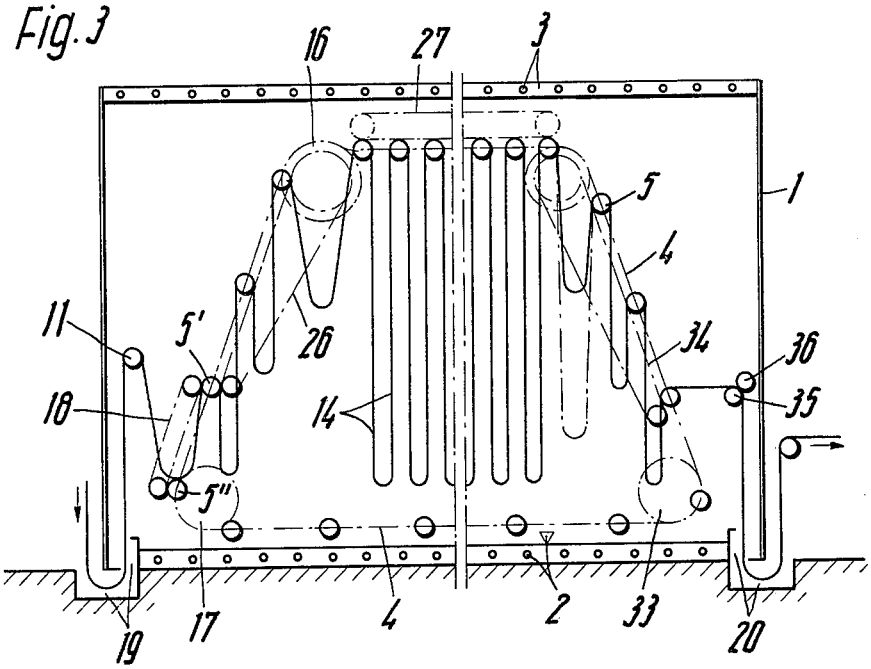
FIG. 3 shows the festoon steamer according to FIG. 2, likewise with loop formation in the lower zone of the height of the apparatus, but with a conveyer chain which is extended obliquely upwardly over the entire height of the apparatus.
Figure 4:
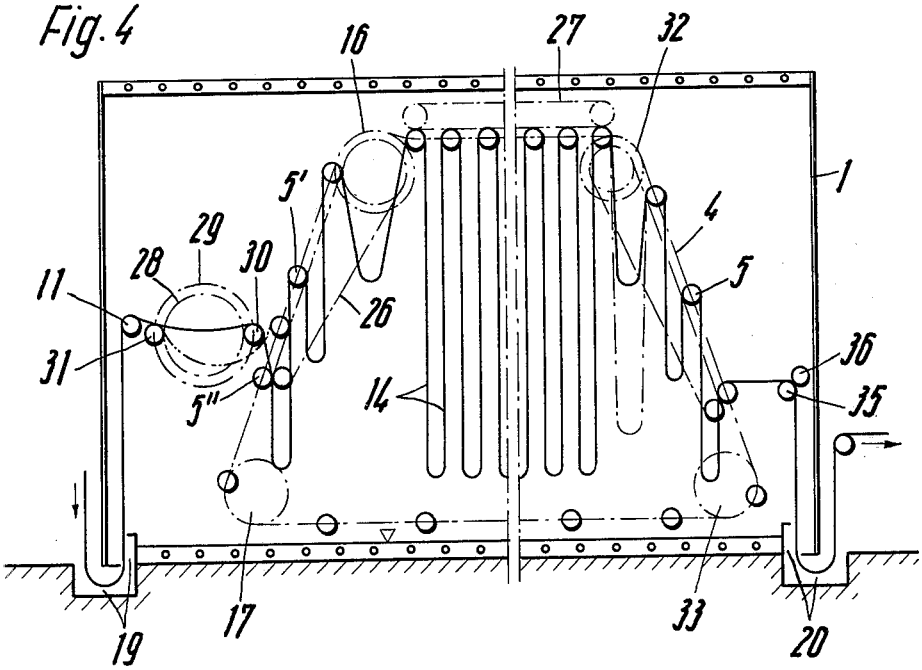
FIG. 4 shows the festoon steamer according to FIG. 3 with an auxiliary loop-forming device.

The embodiments of FIGS. 3 and 4 are similar to that of FIG. 2 in that the loops are first preformed in the lower zone of the height of the apparatus and are then fully formed in the zone of the ceiling. Also, it is possible to associate a sieve drum according to FIG. 2 with the embodiments shown in FIGS. 3 and 4. However, in contrast thereto, in the embodiments of FIGS. 3 and 4, the conveyer chain 4 is extended obliquely upwardly up up to chain sprocket 16 from the chain sprocket 17 without any further deflection.

In the embodiment of FIG. 3, a loop is first formed between the feed roll 11 and the roller 5'. The roller 5' is shown at the end of the first partial path between the chain sprockets 17 and 16. Underneath this level, the first auxiliary chain 18 drives the rollers, which move obliquely upwardly, at approximately the feeding speed. Above this point, the rollers, which continue their upward movement, are driven by the auxiliary chain 26 at a slower speed, in a similar manner as in the embodiment of FIG. 2. The subsequent roller 5'' engages the loop suspended between the feed roll 11 and the subsequent roller 5' approximately in the lower point of reversal. For this purpose, the feed roll 11 must have a certain position with respect to its height level, and the chain 4 must move upwardly with an exactly predetermined inclined direction at a spacing from the feed roll.

At the instant of contact of the preformed loop with the following roller 5'', the latter has a speed which does not produce a relative motion between the outer surface of the roller and the material. Consequently, the roller 5'' will subdivide the loop between the feed roll 11 and the roller 5' in the middle and thus form immediately two loops—one loop to the left and one loop to the right of the roller 5'. The roller 5'' will then move further upwardly and will rotate at a speed predetermined by the auxiliary chain 18. During this step, the loop between the auxiliary roller 11 and the roller 5'' will increase. Simultaneously, the loop between the roller 5'' and the roller 5' will be enlarged, since the roller 5' now rotates at a slower speed due to the auxiliary chain 26.

In the embodiment of FIG. 4, the first auxiliary chain 18 in parallel to the upwardly moving endless chain 4 of FIG. 3 is replaced by an auxiliary chain 28 disposed on a circular disk 29, which is arranged at the level of the feed roll 11 between the latter and the obliquely upwardly moving chain 4. Here, the loop is formed between an auxiliary roller 30 rotating on the disk 29 and the last loop-forming roller 5' of the chain 4. The subsequent loop-forming roller 5'' is then conducted laterally upwardly into this preformed loop; during its further upward movement by the chain 4, the roller 5'' is accelerated in its peripheral velocity by means of the auxiliary chain 26 and lifts off the loop and takes the same over unchanged. This position is illustrated with dot-dash lines. The subsequent loop is then preformed between the upwardly moving roller 5'' and a further auxiliary roller 31 at the disk 29. Of course, the disk can also be constructed to have a crosswise structure of shafts or the like. Also, the auxiliary chain 28 can be replaced by spur gears.

In all embodiments 1 through 4, the manner in which the loops are dissolved is the same. In all cases, the conveying chain 4 is traveling obliquely downwardly in an extended form from the chain sprocket 32 to the chain sprocket 33. These downwardly moving rollers are accelerated in their peripheral speed by the auxiliary chain 34, so that one loop after the other is pulled apart between the last roller afffected by the auxiliary chain 13 or 27, respectively, and the already downwardly moving roller, so that only approximately one-half of a loop remains. In this connection, care must again be taken that the weight of the loop to be dissolved is at most equal to the weight of the material of the exiting loop, plus the frictional force of the material on the associated roller. This prevents a sliding back of the material into the suspended loop which is still fully formed.

The final discharge of the material from the steamer is effected by means of a take-off roll 35 rotating at the feeding speed and associated, for safety purposes, with another roller 36 for the formation of a nip. This bilateral contacting of the material is without significance at this point, which is after termination of the fixation period.

A special advantage of all embodiments is that, independently of the length of the loops in the zone of the auxiliary chain 13 or 27, the subsequent loops can be formed at any desired length. It is merely necessary to regulate the speed of the respective auxiliary chains, at a uniform or varying feeding speed of the material. In this manner, the steamer can also be fed with only a short feed piece of material. This feed piece of material can be pulled so that it is extended over all rollers arranged in the range of influence of the three auxiliary chains. The first loop will be formed independently thereof in the desired manner, depending on the set speeds of the auxiliary chains.

In all embodiments, the material is moved continuously over the supporting or conveying rollers. Thus, contact heating cannot be effected. This also holds true during the dwell treatment, since the rollers, which have been placed in close proximity to one another, rotate in the zone of the ceiling continuously, but slowly.

Figure 5:
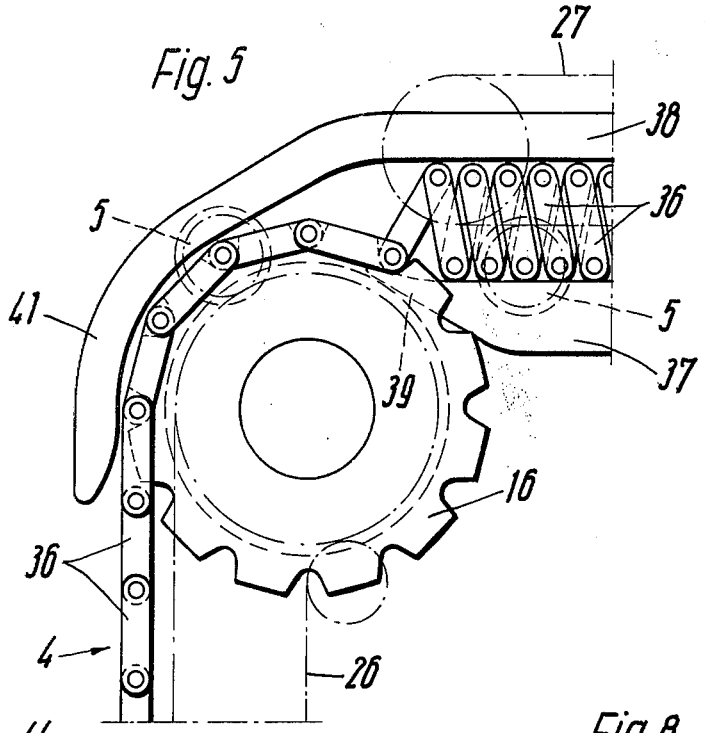
FIG. 5 shows, in an enlarged view, a chain conveyer wheel in the zone of the ceiling of the apparatus with the associated chain-guide rail.
Figure 6:
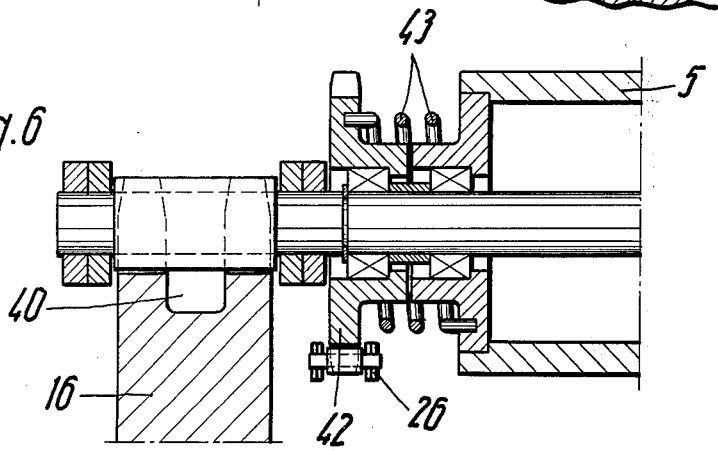
FIG. 6 shows a longitudinal section through a conveying roller according to FIG. 5.

The manner in which it is made possible for the rollers to be arranged in close vicinity in the range of influence of the auxiliary chain 13 or 27, whereas they otherwise pass through the steamer housing at large spacings from one another, is shown in FIG. 5. The chain consists of chain links 36' which can be tilted upwardly and downwardly in the manner of an accordion, so that they are upright and in close contact with one another. The telescoping action is provided by the arrangement of the supporting rails 37, 38 disposed in the zone of the ceiling of the apparatus. These rails are disposed in relation to the chain sprocket 16 so that an automatic telescoping of the chain links 36 can be effected. For this purpose, a tongue 39 of the lower supporting rail 37 engages, for providing a supporting action, the annular groove 40 of the chain sprocket 16 disposed in front thereof. The annular groove 40 can be seen from FIG. 6. Thus, each chain link is forcibly lifted off the sprocket 16 and urged between the rails 37 and 38. In order to prevent the chain from lifting off of the sprocket 16, the chain sprocket 16 passes around the free end of the top rail 38 as a guide rail 41.

Figure 7:
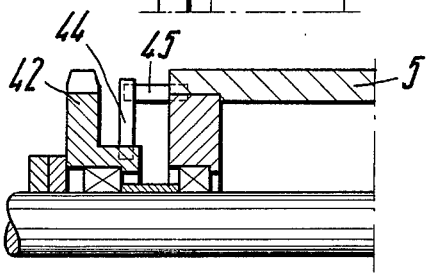
FIG. 7 shows a longitudinal section through a conveying roller in a different construction as compared to FIG. 6.
Figure 8:
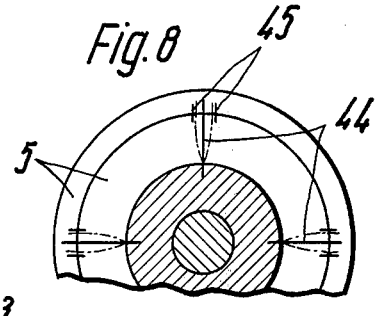
FIG. 8 is a section at right angles through the conveying roller of FIG. 7.

A maximally gently conveyance of the material is accomplished if the material coming into contact with rollers does not have a relative speed with respect to these rollers. Therefore, it is advantageous to accelerate the rollers 5 prior to contact with the material. The accelerative force can assume a high value, and therefore, also in order to reduce wear on the chain, the acceleration should not be sudden, but rather elastic-like, i.e., gradual. For this purpose, the cogwheel 42 attached to the end face of each roller and engaging the auxiliary chain is joined to the roller 5 in a torsional-elastic manner. According to FIG. 6, this is achieved with the aid of a helical torsion spring 43 which is fixedly joined, on the one hand, with the cogwheel 42 and, on the other hand, with the roller 5. Another embodiment is shown in FIGS. 7 and 8, where plate springs 44 which project elastically radially from the shaft journal of the cogwheel 42, are attached and are limited in their movement by stops 45. These stops are axially attached to the roller 5 and extend across the range of rotation of the springs 44. The mode of operation of the plate springs is explained by the illustration of FIG. 8. Both embodiments are elastic torsional connections for decelerating or accelerating velocities.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

What is claimed is:

1. A process for the formation of loops of textile material freely suspended over a plurality of successive supporting roller means for the conveyance of the textile material which is sensitive to longitudinal tension through a treatment chamber slowly traversed by the supporting means supported by an endless conveying means wherein the supporting means coming into contact with the textile material are maintained constantly in rotation during formation of the loops of textile material, and the loop formation is accomplished by producing a relative motion between successive supporting means with respect to one another on said endless conveying means, and by providing substantially no relative motion between the supporting means and the textile material, said loop formataking place between supporting roller means rotating at different speeds and the material being supported thereon solely by friction.

2. The process according to claim 1, in which the material comes into contact with the supporting means only on one side, until termination of the treatment, during the loop formation.

3. The process according to claim 1, in which the continuously rotating supporting means contacting the material during the loop formation are additionally caused to vary their mutual distance between each other.

4. The process according to claim 1, in which the textile material, upon its first contact with a supporting means on said endless conveying means, exactly maintains its feeding speed.

5. The process according to claim 4, in which the respectively following, loop-forming supporting means upon first contact with the material, moves longitudinally and rotates at velocities which together result in the feeding speed of the material.

6. The process according to claim 4, in which the supporting means is accelerated to the material feeding speed already prior to coming into contact with the material.

7. The process according to claim 4, in which the acceleration or deceleration of the supporting means is throttled to the respective speed of the material in the treatment chamber.

8. The process according to claim 1, in which the loops between two successive supporting means are first preformed and only subsequently are lengthened to the desired loop length.

9. The process according to claim 8, in which the supporting means which again comes into contact with the material rotates at a high speed, while the following supporting means moves more slowly and, in turn, following supporting means or preferably only several elements farther on, move at an even further reduced speed.

10. The process according to claim 8, in which the material is taken over, in the zone of the ceiling of the treatment chamber by a supporting means rotating at the material feeding speed, and the loop is formed between this supporting means and the following, more slowly moving supporting means.

11. The process according to claim 8, in which the accelerated, upwardly traveling supporting means is placed into engagement with the underside of a loop already formed between a fixed auxiliary roll and one of said supporting means, thus forming from the single loop two loops laterally suspended from this said one of said supporting means.

12. The process according to claim 8, in which the accelerated, upwardly traveling supporting means is laterally guided into a loop already formed between an auxiliary roll and one of said supporting means, thus taking over this loop in an unchanged condition.

13. The process according to claim 1, in which the material, for the loop formation, is transported without tension into the zone of the ceiling of the treatment chamber while being contacted only on one side, and the loop formation is only effected at that zone.

14. The process according to claim 13, in which the material is taken over, in the zone of the ceiling, by a supporting means rotating at the material feeding speed, and the loop is formed between this supporting means and the following, more slowly moving supporting means.

15. The process according to claim 1, in which also the supporting means at the end of the treatment chamber rotate in a driven manner during the dissolution of the loops, and the loops are likewise shortened by differential speeds of the successive supporting means.

16. The process according to claim 1, wherein the textile material is in the form of a continuous web and said treatment chamber is a steamer housing.

17. The process according to claim 16, in which the supporting roller means comprise a plurality of rollers laterally arranged in parallel relationship to each other within said treatment chamber, said process further comprising engaging the web material with said rollers by friction alone.

18. The process according to claim 1, in which the endless conveying means is an endless conveyor chain means.

19. The process according to claim 1, in which the formation of said loops of textile material is effected at an initial front portion of said treatment chamber.

20. An apparatus for producing loops of textile material which comprises a steamer housing including a dwell section, an endless conveyor means longitudinally traversing said housing, said conveyor means comprising two chain means respectively guided laterally within said housing, a plurality of supporting roller means for supporting and for conveying loops of textile material within said housing, said supporting roller means being transported and held laterally within said housing by said endless conveyor means, said conveyor means while moving the loops of textile material through the dwell section of the housing effecting change in position of the loops with respect to the supporting roller means, means for continuously rotating the supporting roller means coming into contact with the textile material during loop formation to effect continuous movement of the textile material over successive supporting means, said conveyor means effecting relative motion between successive supporting roller means during loop formation and said means for rotating said supporting roller means providing substantially no relative motion between the roller means and the moving textile material and including auxiliary means for causing the supporting roller means on which the loop formation take place to rotate at different peripheral speeds.

21. The apparatus according to claim 20, in which said auxiliary means includes three auxiliary chain means having means which engage said supporting roller means for effecting rotation thereof at said different peripheral speeds, respectively.

22. The apparatus according to claim 21, in which said supporting roller means include a plurality of rollers which are positioned in parallel relationship between said two chain means, said rollers engaging said textile material by friction alone.

23. The apparatus according to claim 20, in which the supporting means comprise loop-forming rollers that are driven by at least one auxiliary chain.

24. The apparatus according to claim 23, in which, for the formation of the loops, the peripheral speed of at least two successive rollers on said conveyor means is different.

25. The apparatus according to claim 23, in which the spacing between the respective rollers is variable, wherein the spacing between a subsequent roller is always uniformly small or uniformly large.

26. The apparatus according to claim 25, in which the spacing of a certain number of rollers is always uniform, but the spacing of the rollers with formed loops is smaller than the spacing of the rollers without loops or with only partially formed loops.

27. The apparatus according to claim 26, in which the spacing of the rollers with fully formed loops in minor, while the otherwise rotating rollers are arranged on the conveyer means including said chain means at uniformly large spacings for being transported back to the beginning of the treatment apparatus.

28. The apparatus according to claim 25, in which the chain means include chains consisting of chain links which can be pushed into one another.

29. The apparatus according to claim 28, in which the chain links can be tilted upwardly and downwardly accordion-like so that they are disposed upright in close proximity to one another.

30. The apparatus according to claim 28, in which the rollers are attached at large spacings to the chains held in a straight extended condition.

31. The apparatus according to claim 25, in which the loop to be formed between two rollers is suspended therebetween with a large spacing between the rollers, and these two rollers are driven at differential peripheral speeds.

32. The apparatus according to claim 31, in which the weight of the loop partially formed or to be formed between the two rollers is at most equal to the weight of the material between the subsequent roller and the preceding roller plus the frictional force of the material on this subsequent roller.

33. The apparatus according to claim 31, further comprising means for conveying the material obliquely upwardly up into the zone of the ceiling of the treatment apparatus, said conveying means including driven rollers and a sieve drum under a suction draft, said conveying means being so arranged that the material extends from the end of this conveying means first straight to the preceding roller and then, for the formation of the loop, the material is freely suspended between two successive guide rollers.

34. The apparatus according to claim 31, in which, following a sieve drum under a suction draft, but behind the inlet-side end wall of the housing, in the lower zone of the height of the apparatus, a feed roll is disposed which rotates at the feeding speed and is heated, the first loop being formed between this feed roll or another auxiliary roll and a subsequent roller.

35. The apparatus according to claim 34, in which the conveyer chain with the rollers is obliquely downwardly directed a small distance below the feed roll in the direction of feeding of the material, for a distance corresponding approximately to the spacing between two supporting rollers when the conveyer chain is stretched straight, and thus the subsequent roller represents a supporting roller at the conveyer chain.

36. The apparatus according to claim 35, in which the rollers are driven in the zone of the straight extension of said material by a first auxiliary chain.

37. The apparatus according to claim 35, in which the conveyer chain after said extension of material is guided slightly obliquely in the upward direction up into the zone of the ceiling of the apparatus, and, over this length, the rollers suspended at the chain are driven by means of a second auxiliary chain at a peripheral speed which is lower as compared to that of the first auxiliary chain.

38. The apparatus according to claim 31, in which a heated feed roll rotating at the feeding speed is arranged behind the inlet-side end wall of the housing, most advantageously in the lower zone of the height of the apparatus, and the conveyer chain with the rollers is extended close to the inlet so that it travels obliquely upwardly over the entire height, wherein, in the lower zone of this height, a first auxiliary chain for driving the rollers is provided over the length of the distance of two successive rollers when the chain is in the extended condition.

39. The apparatus according to claim 38, in which the feed roll is disposed in relationship to the spacing from and to the incline of the upwardly moving chain in such a manner that the roller forming the next loop touches the loop suspended between the feed roll and the last loop-forming roller approximately in the lower point of return thereof.

40. The apparatus according to claim 39, in which, following the first auxiliary chain, a second auxiliary chain is arranged over the residual length of the obliquely upwardly moving chain, with a peripheral speed which is lower as compared to that of the first auxiliary chain, for driving the respective rollers to be conveyed upwardly in this zone.

41. The apparatus according to claim 40, in which, at the end of the upward movement, the conveyer chain with the rollers is again deflected into the horizontal, and the rollers are at that point driven with a horizontally extended, third auxiliary chain with a peripheral speed which is lower as compared to the preceding second auxiliary chain.

42. The apparatus according to claim 20, in which each of said rollers has a cogwheel at one of their ends for driving purposes, which cogwheel engages a respectively associated auxiliary chain.

43. The apparatus according to claim 42, in which the cogwheel is secured with the roller by a torsional-elastic coupling.

44. The apparatus according to claim 43, in which the elastic, torsional coupling is constituted by a helical torsion spring or a plate spring.

45. The apparatus according to claim 42, in which a chain sprocket of the conveyer means has a peripheral annular groove in the zone of the ceiling at the material inlet, which groove is engaged by guide means including a tongue of a lower rail guiding the telescoped chains for a safe transfer of the chain links.

46. The apparatus according to claim 42, in which the chain sprocket is encompassed by a guide rail in the zone of the ceiling at the material inlet, with an angle approximately corresponding to the angle formed by the conveyor chain.

47. The apparatus according to claim 46, in which this guide rail is the free end of a top rail of the guide means receiving the folded chain.

48. The apparatus according to claim 34, in which the subsequent roller is formed as an auxiliary roller disposed between the feed roll and the chain supported rollers, for the purpose of preforming loops, which auxiliary roller is reciprocated between the feed roll and the conveyer chain.

49. The apparatus according to claim 48, in which the auxiliary roller is guided circularly on a disk which rotates and is mounted in parallel to the longitudinal wall of the apparatus, and a separately driven first auxiliary chain associated with the auxiliary rollers rotates together with the disk.

50. The apparatus according to claim 49, in which the conveyer chain is extended obliquely downwardly at the end of the apparatus, and an auxiliary chain for more rapid driving is associated with the rollers which are suspended at that point on the stretched-straight chain.

51. The apparatus according to claim 50, in which a take-off roll, rotating at the feeding speed, is disposed in front of the outlet-side end wall of the housing in the lower zone of the apparatus.

52. The apparatus according to claim 52, in which said take-off roll is associated with a further roll for the formation of a nip that engages said material.

53. The apparatus according to claim 51, in which the take-off roll is arranged at such a level that the weight of the loop to be dissolved is at most equal to the weight of the material of the exiting loop, plus the force of friction of the material on this roll.

* * * * *